US005134442A

United States Patent [19]

Folkins et al.

[11] Patent Number: 5,134,442

[45] Date of Patent: Jul. 28, 1992

[54] ELECTRODE WIRE CONTAMINATION PREVENTION AND DETECTION

[75] Inventors: Jeffrey J. Folkins, Rochester; Samuel W. Ing, Webster, both of N.Y.

[73] Assignee: Xerox Corporation, Stamford, Conn.

[21] Appl. No.: 558,277

[22] Filed: Jul. 26, 1990

[51] Int. Cl.[5] ..... G03G 15/06; G03G 21/00

[52] U.S. Cl. ..... 355/264; 118/652; 355/215; 355/261

[58] Field of Search ..... 355/261, 264, 247, 249, 355/259, 215, 30, 246, 262; 118/652, 647, 648, 650

[56] References Cited

U.S. PATENT DOCUMENTS

| | | | |
|---|---|---|---|
| 3,865,080 | 2/1975 | Hudson | 118/648 |
| 4,025,184 | 5/1977 | Mochizuki | 355/264 X |
| 4,260,243 | 4/1981 | Dolan et al. | 118/652 X |
| 4,529,295 | 7/1985 | Mayer | 355/15 |
| 4,647,186 | 3/1987 | Armstrong et al. | 118/652 |
| 4,868,600 | 9/1989 | Hays et al. | 355/259 |
| 4,913,348 | 4/1990 | Hays | 430/45 |
| 4,984,019 | 1/1991 | Folkins | 355/215 |

*Primary Examiner*—A. T. Grimley
*Assistant Examiner*—Nestor R. Ramirez

[57] ABSTRACT

An apparatus in which a developer unit of an electrophotographic printing machine has a plurality of wires which trap contaminants before reaching electrode wires positioned between a donor roller and a photoconductive surface. In addition, a circuit determines when defects and deletions are caused by contaminants spacing the electrode wires from the donor roller.

32 Claims, 3 Drawing Sheets

ELECTRODE WIRE CONTAMINATION PREVENTION AND DETECTION

Figure 1:
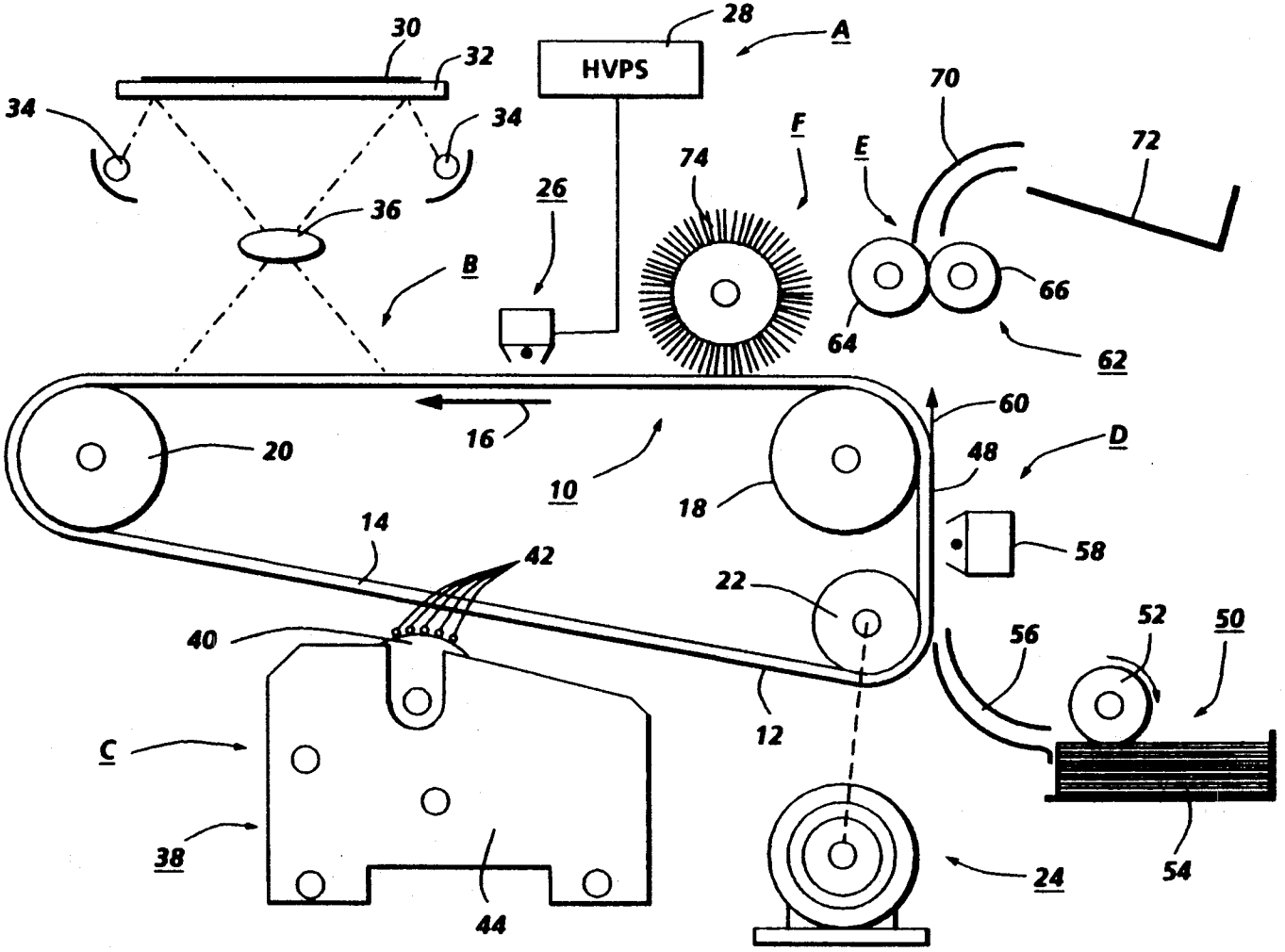

This invention relates generally to an electrophotographic printing machine, and more particularly concerns preventing contamination of electrode wires interposed between a photoconductive surface and a donor roller of a developer unit used to develop a latent image recorded on the photoconductive surface.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive surface. The toner powder image is subsequently transferred to a copy sheet. Finally, the toner powder image is heated to permanently fuse it to the copy sheet in image configuration.

Single component development systems use a donor roll for transporting charged toner to the development nip defined by the donor roll and photoconductive member. The toner is developed on the latent image recorded on the photoconductive member by a combination of mechanical and/or electrical forces. Scavengeless development and jumping development are two types of single component development. A scavengeless development system uses a donor roll with a plurality of electrode wires closely spaced therefrom in the development zone. An AC voltage is applied to the wires forming a toner cloud in the development zone. The electrostatic fields generated by the latent image attract toner from the toner cloud to develop the latent image. In jumping development, an AC voltage is applied to the donor roller detaching toner from the donor roll and projecting the toner toward the photoconductive member so that the electrostatic fields generated by the latent image attract the toner to develop the latent image. Single component development systems appear to offer advantages in low cost and design simplicity. However, the achievement of high reliability and easy manufacturability of the system may be present a problem. Two component development systems have been used extensively in many different types of printing machines. A two component development system usually employs a magnetic brush developer roller for transporting carrier having toner adhering triboelectrically thereto. The electrostatic fields generated by the latent image attract the toner from the carrier so as to develop the latent image. In high speed commercial printing machines, a two component development system may have lower operating costs than a single component development system. Clearly, two component development systems and single component development systems each have their own advantages. Accordingly, it is desirable to combine these systems to form a hybrid development system having the desirable features of each system. For example, at the 2nd International Congress on Advances in Non-impact Printing held in Washington, D.C. on Nov. 4–8, 1984, sponsored by the Society for Photographic Scientists and Engineers, Toshiba described a development system using a donor roll and a magnetic roller. The donor roll and magnetic roller were electrically biased. The magnetic roller transported a two component developer material to the nip defined by the donor roll and magnetic roller. Toner is attracted to the donor roll from the magnetic roll. The donor roll is rotated synchronously with the photoconductive drum with the gap therebetween being about 0.20 millimeters. The large difference in potential between the donor roll and latent image recorded on the photoconductive drum causes the toner to jump across the gap from the donor roll to the latent image so as to develop the latent image. A similar type of hybrid development system may employ scavengeless development.

In a scavengeless development system, fibers, beads and toner agglomerates are frequently trapped by the electrode wires. This results in contamination of the electrode wires causing deletions and defects in the toner image developed on the photoconductive surface. The severity of this problem is dependent upon many factors such as the number of electrode wires, developed mass, bead carryout performance, etc. In order to achieve the level of performance required on high quality printing machines, it is necessary to reduce contamination of the electrode wires. The following disclosures may be relevant to various aspects of the present invention:

U.S. Pat. No. 4,529,295; Patentee: Mayer; Issued: Jul. 16, 1985.

U.S. Pat. No. 4,868,600; Patentee: Hays et al.; Issued: Sep. 19, 1989.

U.S. Pat. No. 4,913,348; Patentee: Hays; Issued: Apr. 3, 1990.

The relevant portions of the foregoing disclosures may be briefly summarized as follows:

U.S. Pat. No. 4,529,295 describes a self cleaning developing assembly having a series of electrodes to aid in developing an image and in cleaning the latter of developer deposited thereon. The electrodes are elongated, parallel and closely spaced within a housing adjacent to the photoconductive drum.

U.S. Pat. No. 4,868,600 discloses a scavengeless development system having electrode wires positioned adjacent a donor roller transporting toner. An AC electric field is applied to the electrode wires to detach the toner from the donor roller forming a toner powder cloud in the development zone.

U.S. Pat. No. 4,913,348 describes a development system structure having an AC biased electrode structure self spaced from a donor roll and another electrode structure self spaced from another donor roll.

In accordance with one aspect of the present invention, there is provided an apparatus for reducing contamination of an electrode member positioned in the space between a surface adapted to have a latent image recorded thereon and a moving donor member. The apparatus includes a plurality of wires positioned prior to the electrode member in the direction of movement of the donor member and closely adjacent to the donor member so that said plurality of wires trap contaminants before the contaminants reach the electrode member.

Pursuant to another aspect of the present invention, there is provided an electrophotographic printing machine of the type in which an electrostatic latent image recorded on a photoconductive member is developed to form a visible image thereof. The improvement includes a moving donor member spaced from the photoconductive member and being adapted to transport toner to a region opposed from the photoconductive member. An electrode member is positioned in the space between the photoconductive member and the donor member. Means, positioned prior to the electrode member in the direction of movement of the donor member and closely adjacent to the donor member, trap contaminants before the contaminants reach the electrode member.

In another aspect of the present invention, there is provided an apparatus for developing a latent image recorded on a member. The apparatus includes a moving donor member spaced from the member and adapted to transport toner to a region opposed from the member. An electrode member is positioned in the space between the member and the donor member. The electrode member has contaminants thereon. Means are provided for detecting contamination of the electrode member.

Finally, there is provided an electrophotographic printing machine of the type in which an electrostatic latent image recorded on a photoconductive member is developed to form a visible image thereof. The improvement includes a moving donor member spaced from the photoconductive member and adapted to transport toner to a region opposed from the photoconductive member. An electrode member is positioned in the space between the photoconductive member and the donor member. Means are provided for detecting contamination of the electrode member.

Figure 2:
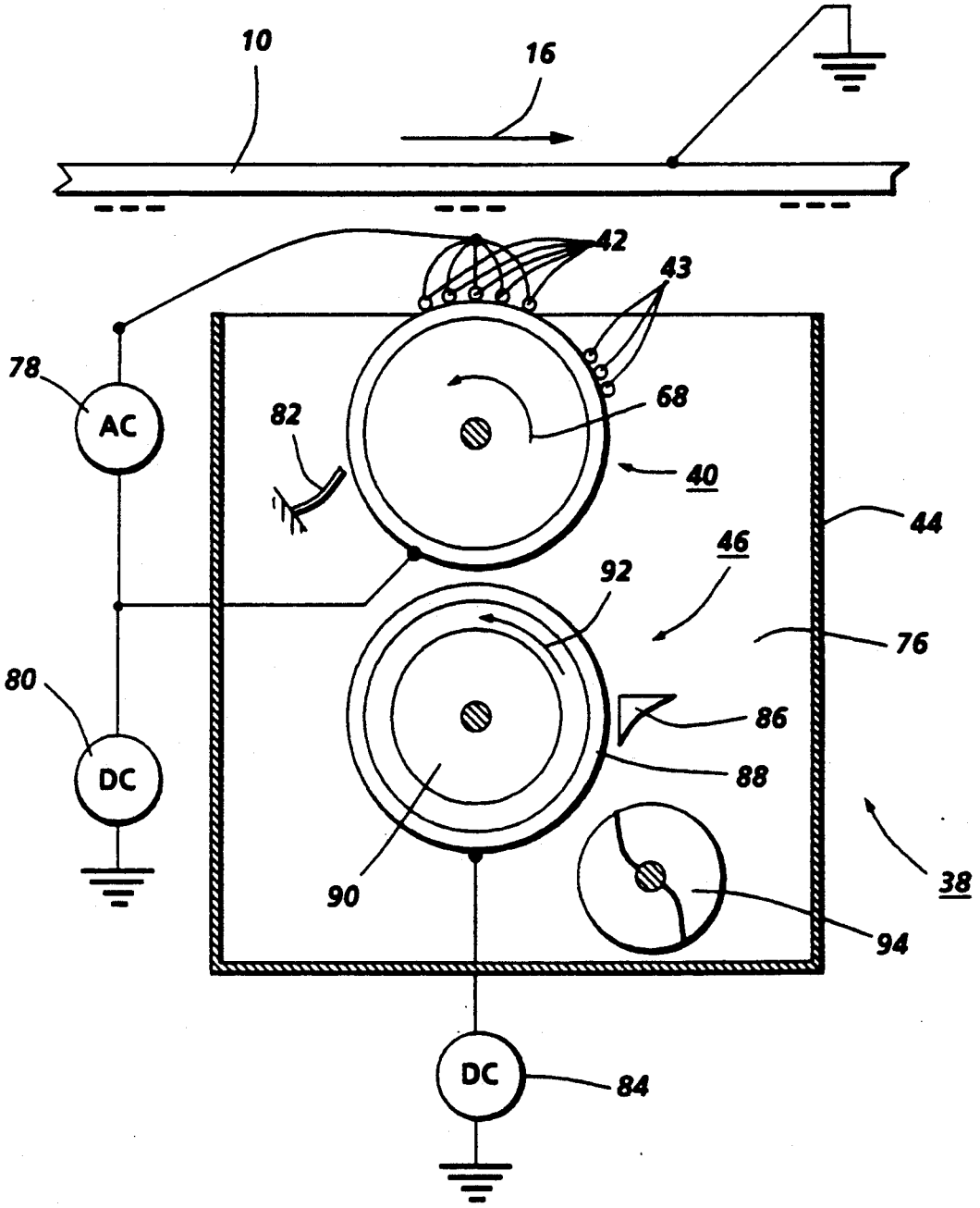
Figure 3:
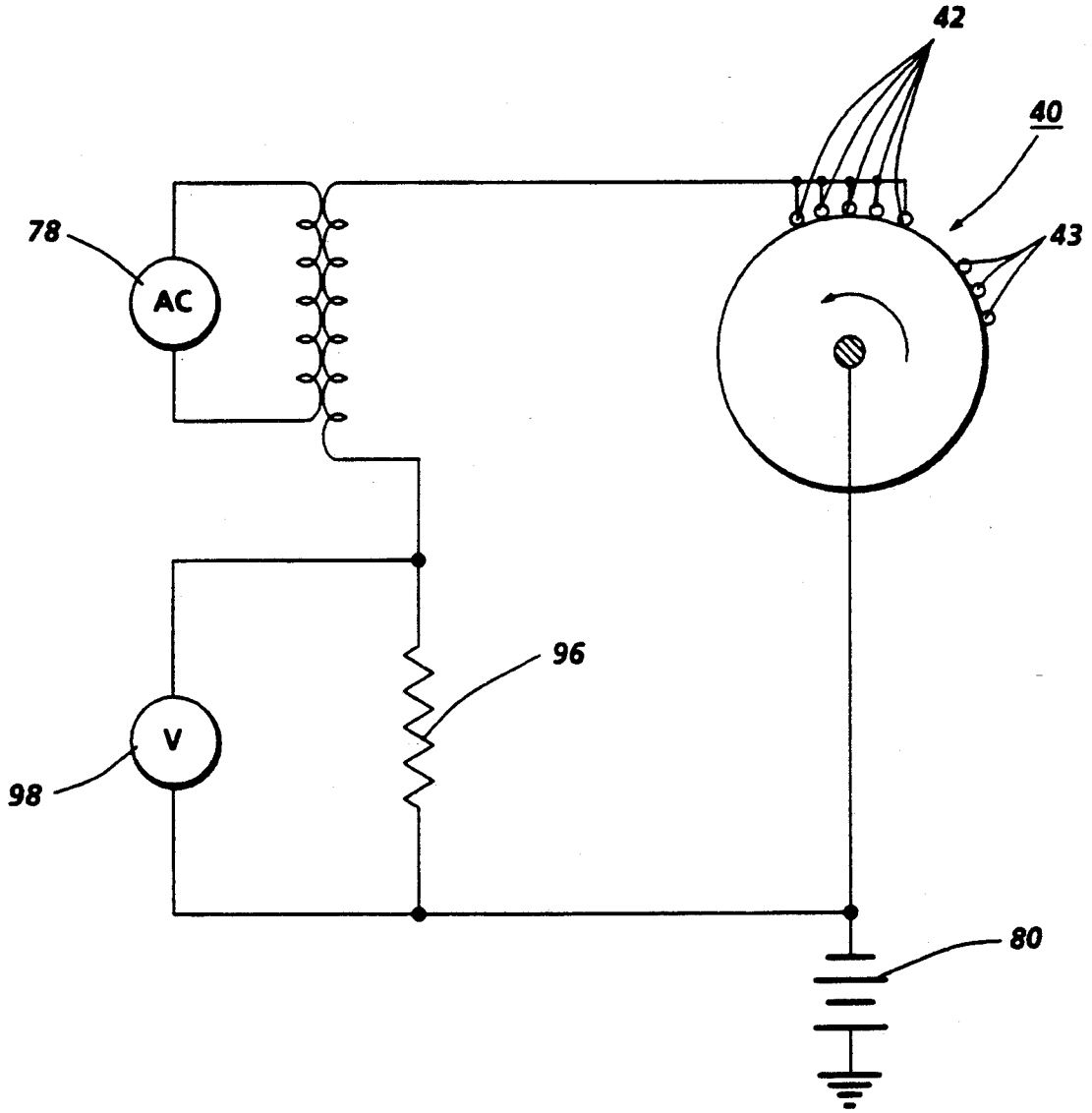

Other features of the present invention will become apparent as the following description proceeds and upon reference to the drawings, in which:

FIG. 1 is a schematic elevational view of an illustrative electrophotographic printing machine incorporating the features of the present invention therein; and FIG. 2 is a schematic elevational view showing the developer unit used in the FIG. 1 printing machine; and FIG. 3 is a circuit diagram illustrating the technique for detection of electrode wire contamination.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roller 40, electrode wires 42 and contamination trapping wires 43 (FIG. 2). During development of the latent image, donor roller 40 advances toner past wires 43 which remove contaminants therefrom and to the region of electrode wires 42. Electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. In normal operation, electrode wires 42 contact donor roller 40. When contaminated, electrode wires 42 are spaced from donor roller 40. Donor roller 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller 46 (FIG. 2) disposed interiorly of the chamber of housing 44 conveys the developer material to the donor roller. The magnetic roller is electrically biased relative to the donor roller so that the toner particles are attracted from the magnetic roller to the donor roller. Developer unit 38 will be discussed hereinafter, in greater detail, with reference to FIG. 2.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine having a developer unit incorporating the features of the present invention therein.

Referring now to FIG. 2, there is shown developer unit 38 in greater detail. As shown thereat, developer unit 38 includes a housing 44 defining a chamber 76 for storing a supply of developer material therein. Donor roller 40, electrode wires 42, trapping wires 43 and magnetic roller 46 are mounted in chamber 76 of housing 44. The donor roller can be rotated in either the 'with' or 'against' direction relative to the direction of motion of belt 10. In FIG. 2, donor roller 40 is shown rotating in the direction of arrow 68, i.e. the against direction. Similarly, the magnetic roller can be rotated in either the 'with' or 'against' direction relative to the direction of motion of donor roller 40. In FIG. 2, magnetic roller 46 is shown rotating in the direction of arrow 92 i.e. the against direction. Donor roller 40 is preferably made from anodized aluminum. Electrode wires 42 are disposed in the space between the belt 10 and donor roller 40. The electrode wires are normally in contact with donor roller 40. A plurality, i.e. five, electrode wires are shown extending in a direction substantially parallel to the longitudinal axis of the donor roller. Each electrode wire is made from thin (i.e. 50 to 100μ diameter) tungsten wires. The extremities of the wires are supported by the tops of end bearing blocks which also support the donor roller for rotation. The wire extremities are attached so that they are tangent to and in contact with the surface of the donor roller. Mounting the wires in such a manner makes them insensitive to roll runout due to their self-spacing.

As illustrated in FIG. 2, an alternating electrical bias is applied to the electrode wires by an AC voltage source 78. In operation, the applied AC establishes an alternating electrostatic field between the wires and the donor roller which is effective in detaching toner from the surface of the donor roller and forming a toner cloud about the wires, the height of the cloud being such as not to be substantially in contact with the belt 10. During operation, the magnitude of the AC voltage is relatively low and is in the order of 200 to 600 volts peak at a frequency ranging from about 3 kHz to about 10 kHz. A DC bias supply 80 which applies approximately 300 volts to donor roller 40 establishes an electrostatic field between photoconductive surface 12 of belt 10 and donor roller 40 for attracting the detached toner particles from the cloud surrounding the wires to the latent image recorded on the photoconductive surface. The use of a dielectric coating on either the electrode wires or donor roller prevents shorting of the applied AC voltage. A cleaning blade 82 strips all of the toner from donor roller 40 after development so that magnetic roller 46 meters fresh toner to a clean donor roller. Magnetic roller 46 meters a constant quantity of toner having a substantially constant charge on to donor roller 40. This insures that the donor roller provides a constant amount of toner having a substantially constant charge in the development gap. In lieu of using a cleaning blade, the combination of donor roller spacing, i.e. spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantially constant charge on the donor roller. During operation, DC bias supply 84 applies approximately 100 volts to magnetic roller 46 relative to donor roller 40 to establish an electrostatic field between magnetic roller 46 and donor roller 40 which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the nip defined by donor roller 40 and magnetic roller 46. Toner particles are attracted from the carrier granules on the magnetic roller to the donor roller.

With continued reference to FIG. 2, augers, indicated generally by the reference numeral 94, are located in chamber 76 of housing 44. Augers 94 are mounted rotatably in chamber 76 to mix and transport developer material. The augers have blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, the carrier granules include a ferromagnetic core having a thin layer of magnetite overcoated with a non-continuous layer of resinous material. The toner particles are made from a resinous material, such as a vinyl polymer, mixed with a coloring material, such as chromogen black. The developer material comprise from about 95% to about 99% by weight of carrier and from 5% to about 1% by weight of toner. However, one skilled in the art will recognize that any suitable developer material having at least carrier granules and toner particles may be used.

Trapping wires 43 are positioned closely adjacent to donor roller 40 prior to electrode wires 42 in the direction of rotation of donor roller 40, as indicated by arrow 68. Wires 43 are stretched across donor roller 40 substantially parallel to its longitudinal axis. As shown, wires 43 are positioned before the development zone, e.g. rotated through an angle of approximately 60° before the development zone as defined by the location of electrode wires 42. The wires form a trap for fibers and debris. In this way, wires 43 catch any large fibers before the development zone. Wires 43 act as a filter which does not disturb the toner pile on the donor roller. By way of example, wires 43 are made from thin (i.e. 50 to 100μ diameter) tungsten wires spaced from about 50 to 100μ from the surface of donor roller 40. One skilled in the art will appreciate that wires 43 may be electrically biased by an AC or a DC voltage source. For example, wires 43 may be connected to AC voltage source 78. The applied bias helps to electrostatically attracted debris particles which may have acquired electric charge as they attached to the surface of the surface of the donor roll. Trapping wires 43 allow the toner on the donor roll surface to pass therebeneath without creating significant nonuniformities, e.g. streaks in the layer of toner. It is thus clear that trapping wires 43 reduce contamination of electrode wires 42 by preventing debris from reaching the electrode wires 42.

Turning now to FIG. 3, there is shown the circuitry for detecting contamination of electrode wires 42. Resistor 96 is connected between AC voltage source 78 and DC voltage source 80. A voltmeter meter 98 is connected in parallel with resistor 96. There is significant capacitance and/or resistive leakage between electrode wires 42 and donor roller 40, e.g. about 10 Mohms. This enables the contact current to be measured. The contact current is reduced significantly when wires 42 are spaced slightly from the surface of donor roller 40. This occurs when contaminants are interposed between wires 42 and donor roller 40. When the wires 42 are spaced from donor roller 40, a voltage is impressed across resistor 96 which is measured by voltmeter 98. This voltage is proportional to the length of the wire spaced from donor roller 40. Inasmuch as print defects from wire contamination are, in most cases, due to the wire being spaced from the donor roller, the contact current measurement ascertains the existence of wire lifting contaminants. In this way, deletions and defects caused by wire lifting contaminants can be determined.

In recapitulation, it is evident that the apparatus of the present invention includes trapping wires located before the electrode wires in the direction of rotation of the donor roller to prevent contaminants from reaching the electrode wires. In addition, deletions and defects caused by the electrode wires being spaced from the donor roller can be determined by a circuit which measures the change in contact current caused by spacing the electrode wires from the donor roller.

It is, therefore, apparent that there has been provided in accordance with the present invention, an apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for reducing contamination of an electrode member positioned in the space between a surface adapted to have a latent image recorded thereon and a moving donor member, including a plurality of wires positioned prior to the electrode member in the direction of movement of the donor member and closely adjacent to the donor member so that said plurality of wires trap contaminants before the contaminants reach the electrode member.

2. An apparatus for reducing contamination of an electrode member positioned in the space between a surface adapted to have a latent image recorded thereon and a moving donor member, including:

a plurality of wires positioned prior to the electrode member in the direction of movement of the donor member, closely adjacent to the donor member so that said plurality of wires trap contaminants before the contaminants reach the electrode member; and means for detecting contamination of the electrode member.

3. An apparatus according to claim 2, wherein said detecting means senses that the electrode member contacts the donor member when uncontaminated and is spaced from the donor member when contaminated.

4. An apparatus according to claim 3, further including means for electrically biasing the electrode member.

5. An apparatus according to claim 4, wherein said electrical biasing means applies an AC electrical bias to said electrode member.

6. An apparatus according to claim 4, wherein said electrical biasing means applies a DC electrical bias to said electrode member.

7. An apparatus according to claim 4, wherein the electrode member includes a plurality of small diameter wires.

8. An apparatus according to claim 7, wherein the donor member includes a roll.

9. An apparatus according to claim 1, further including means for electrically biasing said plurality of wires.

10. An electrophotographic printing machine of the type in which an electrostatic latent image recorded on a photoconductive member is developed to form a visible image thereof, wherein the improvement includes:

a moving donor member spaced from the photoconductive member and being adapted to transport toner to a region opposed from the photoconductive member;

an electrode member positioned in the space between the photoconductive member and said donor member; and means, positioned prior to the electrode member in the direction of movement of the donor member and closely adjacent to the donor member, for trapping contaminants before the contaminants reach the electrode member.

11. An electrophotographic printing machine of the type in which an electrostatic latent image recorded on a photoconductive member is developed to form a visible image thereof, wherein the improvement includes:

a moving donor member spaced from the photoconductive member and being adapted to transport toner to a region opposed from the photoconductive member;

an electrode member positioned in the space between the photoconductive member and said donor member;

means, positioned prior to the electrode member in the direction of movement of the donor member and closely adjacent to the donor member, for trapping contaminants before the contaminants reach the electrode member; and means for detecting contamination of said electrode member.

12. A printing machine according to claim 11, wherein said detecting means senses that said electrode member contacts said donor member when uncontaminated and is spaced from said donor member when contaminated.

13. A printing machine according to claim 12, wherein said trapping means includes a plurality of wires positioned prior to said electrode member in the direction of movement of said donor member and closely adjacent to said donor member so that said plurality of wires trap a substantial portion of the contaminants before the contaminants reach said electrode member.

14. A printing machine according to claim 15, further including means for electrically biasing said electrode member.

15. A printing machine according to claim 14, wherein said electrical biasing means applies an AC electrical bias to said electrode member.

16. A printing machine according to claim 14, wherein said electrical biasing means applies a DC electrical bias to said electrode member.

17. A printing machine according to claim 14, wherein said electrode member includes a plurality of small diameter wires.

18. A printing machine according to claim 17, wherein said donor member includes a roll.

19. An apparatus for developing a latent image recorded on a member, including:

a moving donor member spaced from the member and being adapted to transport toner to a region opposed from the member;

an electrode member positioned in the space between the member and said donor, said electrode member having contaminants thereon; and means for detecting contamination of said electrode member.

20. An apparatus according to claim 19, wherein said detecting means senses that said electrode member contacts said donor member when uncontaminated and is spaced from said donor member when contaminated.

21. An apparatus according to claim 20, further including means for electrically biasing the electrode member.

22. An apparatus according to claim 21, wherein said electrical biasing means applies an AC electrical bias to said electrode member.

23. An apparatus according to claim 21, wherein said electrical biasing means applies a DC electrical bias to said electrode member.

24. An apparatus according to claim 22, wherein the electrode member includes a plurality of small diameter wires.

25. An apparatus according to claim 24, wherein the donor member includes a roll.

26. An electrophotographic printing machine of the type in which an electrostatic latent image recorded on a photoconductive member is developed to form a visible image thereof, wherein the improvement includes:

a moving donor member spaced from the photoconductive member and being adapted to transport toner to a region opposed from the photoconductive member;

an electrode member positioned in the space between the photoconductive member and said donor member; and means for detecting contamination of said electrode member.

27. A printing machine according to claim 26, wherein said detecting means senses that said electrode member contacts said donor member when uncontaminated and is spaced from said donor member when contaminated.

28. A printing machine according to claim 27, further including means for electrically biasing the electrode member.

29. A printing machine according to claim 28, wherein said electrical biasing means applies an AC electrical bias to said electrode member.

30. A printing machine according to claim 28, wherein said electrical biasing means applies a DC electrical bias to said electrode member.

31. A printing machine according to claim 28, wherein the electrode member includes a plurality of small diameter wires.

32. A printing machine according to claim 31, wherein the donor member includes a roll.

* * * * *